US005964357A

United States Patent [19]

Alexander

[11] Patent Number: 5,964,357

[45] Date of Patent: Oct. 12, 1999

[54] SPACIAL ORGANIZER FOR PAPERS

[75] Inventor: Brian D. T. Alexander, Holland, Mich.

[73] Assignee: Haworth, Inc., Holland, Mich.

[21] Appl. No.: 08/983,618

[22] PCT Filed: Jun. 5, 1997

[86] PCT No.: PCT/US97/10572

§ 371 Date: Dec. 31, 1997

§ 102(e) Date: Dec. 31, 1997

[87] PCT Pub. No.: WO97/46149

PCT Pub. Date: Dec. 11, 1997

Related U.S. Application Data

[60] Provisional application No. 60/019,425, Jun. 7, 1996.

[51] Int. Cl.[6] ..... A47F 5/00

[52] U.S. Cl. ..... 211/55; 211/10; 40/124

[58] Field of Search ..... 211/55, 50, 10; 106/32.5; 40/124

[56] References Cited

U.S. PATENT DOCUMENTS 2,153,422 4/1939 Kroman .
2,520,490 8/1950 Boward .
4,938,366 7/1990 Carroll .
5,009,335 4/1991 Jonker .
5,289,926 3/1994 Lewis et al. .

FOREIGN PATENT DOCUMENTS 1 221 737 6/1960 France .
92 04 035 6/1992 Germany .
2 204 479 11/1988 United Kingdom .

*Primary Examiner*—Robert W. Gibson. Jr.
*Attorney, Agent, or Firm*—Flynn, Thiel, Boutell, & Tanis, P.C.

[57] ABSTRACT

A spacial work organizer comprising an upright support arrangement having a generally vertically and horizontally stepped configuration defining a series of generally L-shaped support trays which are disposed in vertically adjoined but horizontally staggered relationship. The support arrangement is preferably of a horizontally concavely curved configuration, whereby a worker can readily position a plurality of documents such as papers and the like on the various vertically spaced trays, with several such documents being disposed in self-supporting relation on each level or tray.

17 Claims, 4 Drawing Sheets

SPACIAL ORGANIZER FOR PAPERS

This application is a 371 of PCT/US97/10572 Jun. 05, 1997, and claims Provisional Application No. 60/019,425 filed Jun. 07, 1996

FIELD OF THE INVENTION

This invention relates to a spacial organizer structure intended for use in an office-type environment for providing increased surface display area, both vertically and horizontally to facilitate both display of and access to a large number of documents, such as papers, to facilitate work in progress by a worker.

BACKGROUND OF THE INVENTION

Most offices provide conventional work surfaces such as tables and desks for supporting papers and-the like. However, with the ever-increasing volume of papers which are affiliated with most jobs, many workers find it difficult to manage or control work-in-progress due to the limited workspace (i.e., table or desk top space) available. More specifically, the worker is often unable to successfully spread out and display a large number of papers or documents.

This invention relates to a spacial organizer which provides for greatly increased surface support area for permitting display and organizational arrangement of numerous documents. More specifically, the spacial arrangement of this invention, within a compact arrangement which more effectively utilizes vertical space, is able to provide greatly increased support and display area for documents and the like, particularly in contrast to conventional desk and table tops, so as to permit a worker to more efficiently perform his tasks.

The work organizer of this invention comprises an upright support arrangement having a generally vertically and horizontally stepped configuration defining a series of generally L-shaped support trays which are disposed in vertically adjoined but horizontally staggered relationship. The overall support tray structure is preferably of a horizontally concavely curved configuration, whereby a worker can readily position a plurality of documents such as papers and the like on the various vertically spaced trays, with several such documents being disposed in self-supporting relation on each level or tray. Several arcuate tray structures can be positioned generally edge to edge to define a greater arcuate configuration, such as a semi-circle, whereupon a worker standing or seated within and partially surrounded by the tray arrangement can readily see, access and organize a large number of documents positioned on the tray arrangement.

Other objects and purposes of the invention will be apparent upon reading the following specification and inspecting the accompanying drawings.

Figure 1:
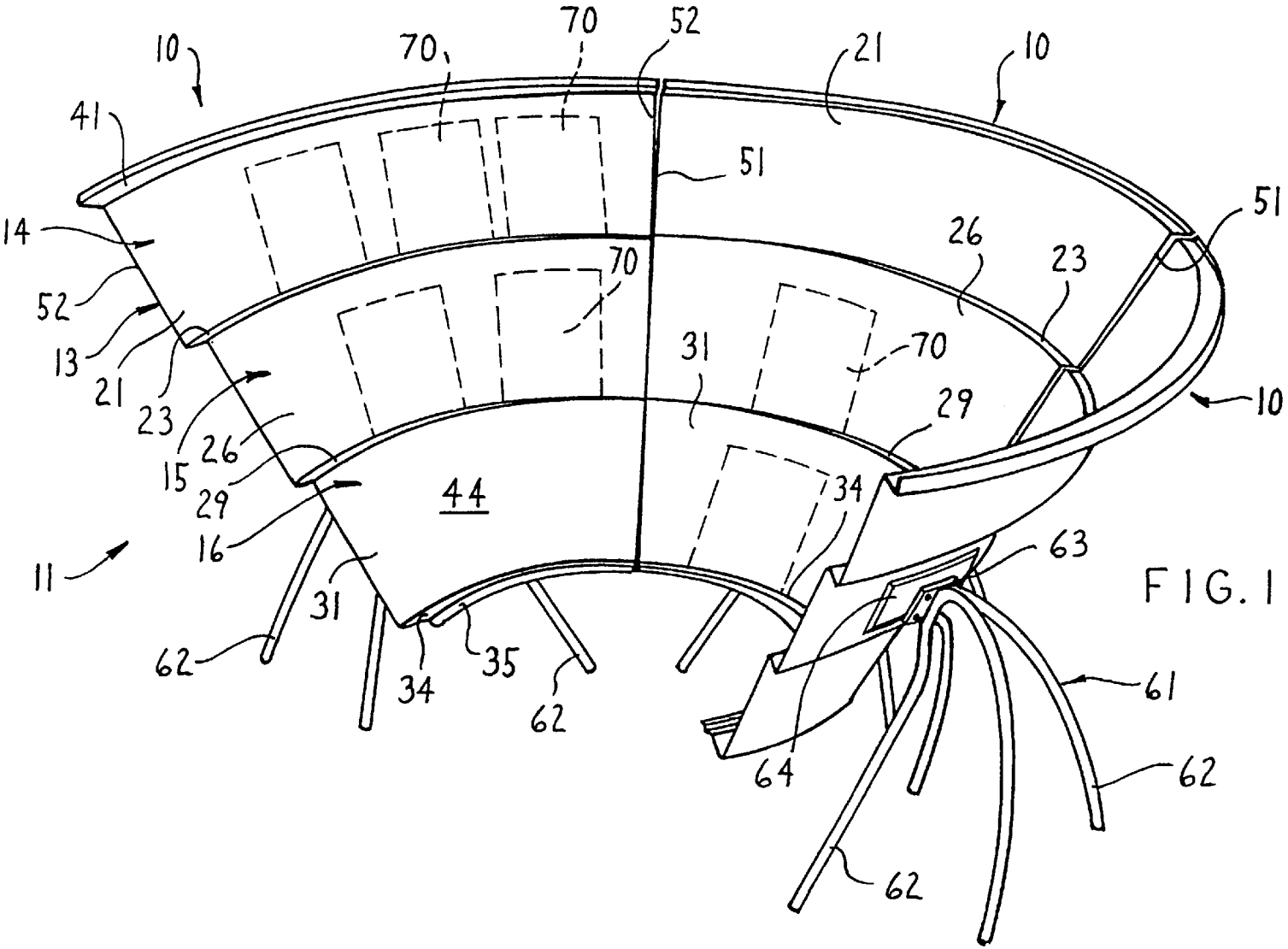
FIG. 1 is a perspective view of a spacial organizer for papers according to the present invention, which organizer as illustrated in FIG. 1 includes three arcuate sections positioned generally edge to edge.

Certain terminology will be used in the following description for convenience in reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the apparatus and designated parts thereof. Said terminology will include the words specifically mentioned, derivatives thereof, and words of similar import.

DETAILED DESCRIPTION

Figure 2:
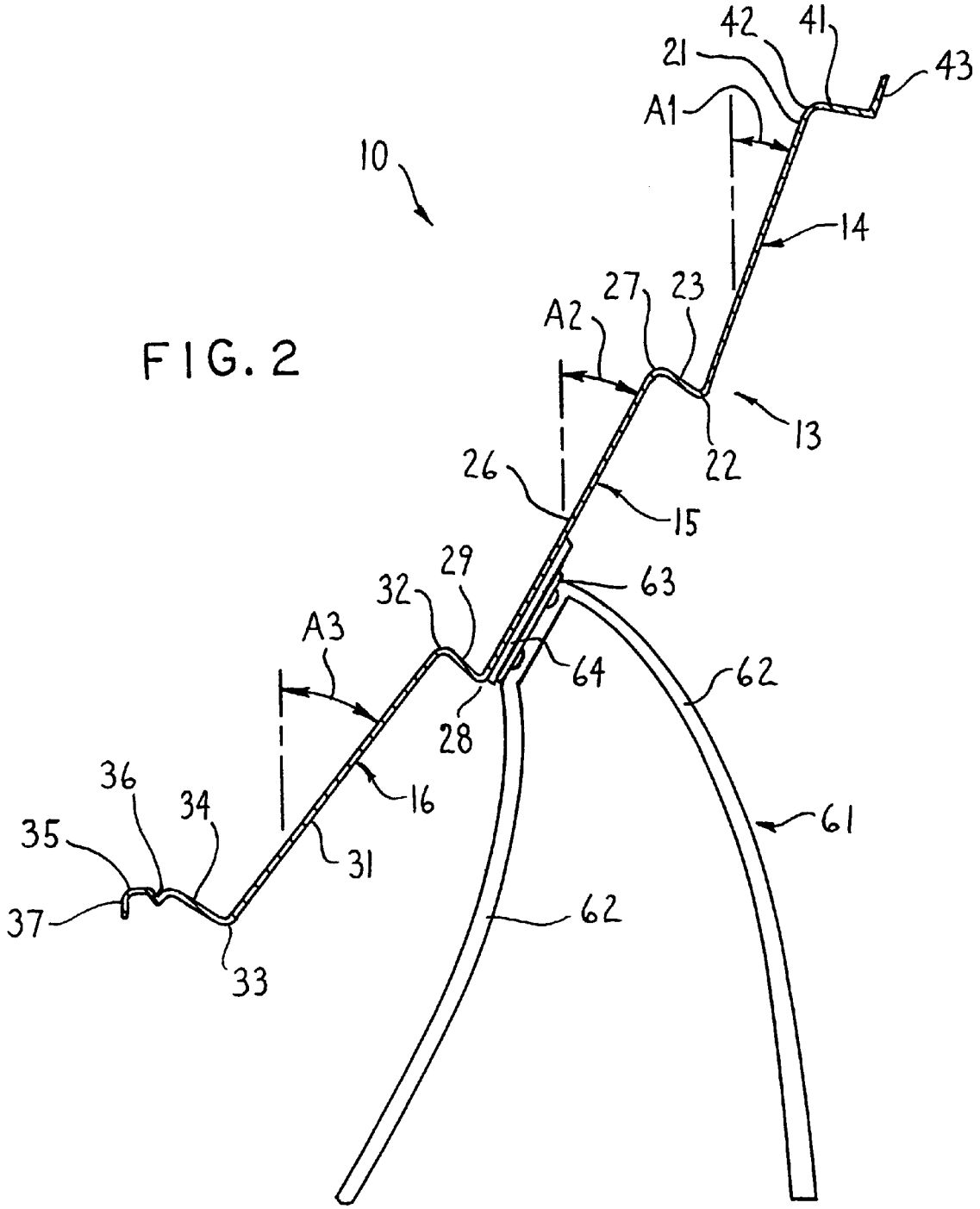
FIG. 2 is a vertical cross-sectional view taken through one of the spacial organizer sections of FIG. 1.
Figure 3:
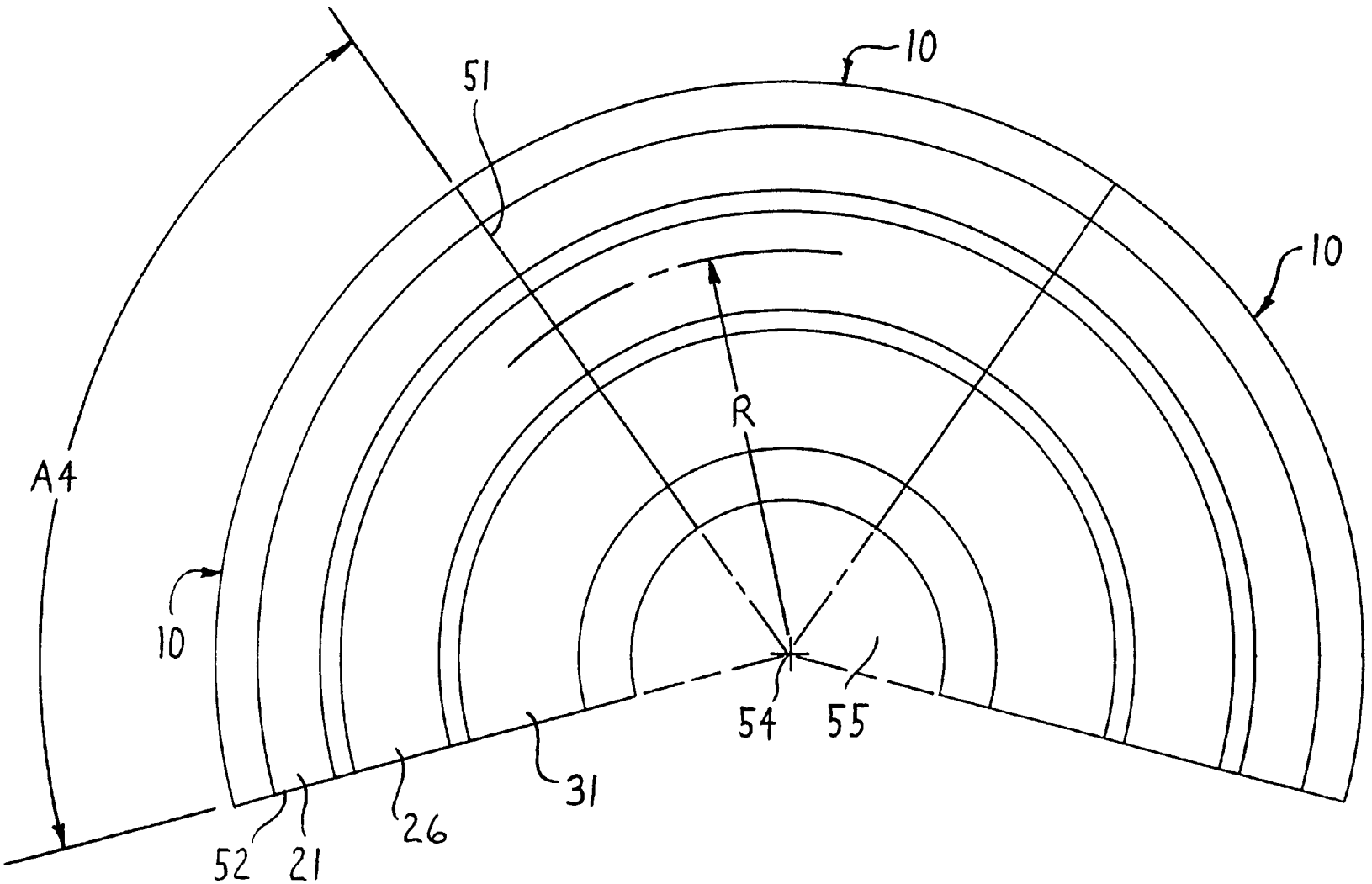
FIG. 3 is a diagrammatic plan view which illustrates the spacial organizer of FIG. 1, the supporting leg structure being eliminated for clarity of illustration.

Referring to FIGS. 1–3, there is illustrated a spacial paper organizer 10 according to the present invention. FIGS. 1 and 3 illustrate three such organizers 10 disposed generally in edge-to-edge relationship so as to define an organizer assembly 11 of increased arcuate extent. It will be appreciated, that the size of each organizer 10 and the number used together, is a matter of choice and size selection, and hence the following description will relate solely to a single organizer 10 since it will be appreciated that a single organizer 10 can be utilized by itself, and in fact a larger organizer could also be constructed as a single assembly if desired, although use of plural smaller organizers positioned in adjacent relationship is preferred both from a manufacturing and a storage standpoint.

The paper organizer 10 as shown in FIG. 2 includes a generally stepped upright paper support 13 which defines a generally L-shaped upper tray or shelf 14 which is vertically joined to an L-shaped middle or intermediate shelf 15, and the latter in turn is vertically joined to a generally L-shaped lower shelf 16. These three shelves 14–16, due to their shape and orientation, are also horizontally offset relative to one another as illustrated by FIG. 2, whereby the upright support 13 when viewed in vertical cross-section has a generally vertically stepped configuration.

The L-shaped upper tray or shelf 14 includes a generally upright wall 21 which projects dominantly upwardly but which is also slightly sloped rearwardly relative to the vertical at an angle Al as it projects upwardly. This generally planar upright wall 21, at its lower end, is joined through an integral rounded corner 22 to a bottom wall 23 which projects transversely away from the front side of the upright wall 21. This bottom wall 23 is also at least slightly upwardly sloped as it projects away from the front side of the upright wall 21, and preferably these walls 21 and 23 at their juncture define an angle therebetween which is preferably slightly less than 90°. This relationship facilitates the upright support of a paper, such as indicated at 70 in FIG. 1, on the shelf since the paper will lean rearwardly against the upright wall 21 and the lower edge of the paper will engage and be supported on the bottom wall or shelf 23. The angular relationship between these walls 21 and 23 assists in maintaining the paper in an upright display position, and assists in preventing the paper from slipping downwardly off of the support shelf.

The L-shaped middle shelf or tray 15 is similarly constructed in that it includes an upright wall 26 which, as it projects upwardly, is also rearwardly sloped at an angle A2 relative to the vertical. This upright wall 26 at its upper edge is joined through an integral rounded corner 27 to the front edge of the bottom wall 23 associated with the upper shelf. The planar upright wall 26, at its lower end, is joined through an integral rounded corner 28 to a generally planar bottom shelf 29, the latter projecting transversely outwardly away from the front face of the upright wall 26. The included angle between the walls 26 and 29 is also preferably slightly less than 90°, as explained above relative to the top shelf.

Lastly, the L-shaped lower shelf 16 is also similarly constructed in that it includes an upright wall 31 which, as it projects upwardly, is also significantly rearwardly sloped at an angle A3 relative to the vertical. The upper end of this planar upright wall 31 is joined through an integral corner 32 to the outer edge of the bottom wall 29 associated with the intermediate shelf 15. The lower edge of upright wall 31 is joined through a rounded integral corner 33 to a bottom wall 34, the latter projecting transversely from the front face of the upright wall 31. In this case, the bottom wall 34 projects approximately perpendicularly away from the upright wall 31 since the increased rearward slope of the upright wall 31 permits use of a substantially right angle at the corner 33 without interfering with proper support of papers on the lower shelf.

In the shelves 14–16 as described above, each of the planar upright walls has a length as measured between upper and lower edges thereof which is significantly greater than the length (i.e., width) of the respective bottom wall as measured between the front and rear edges thereof. For example, the upright walls 21, 26 and 31 preferably have a length in the order of at least about 14 inches so as to readily accommodate thereon all conventional paper sizes, whereas the bottom walls or trays 23, 29 and 34 will typically be only 2 to 3 inches wide.

In addition, the angle A3 will significantly exceed the angle A2 and the latter in turn will exceed the angle A1. This thus results in each of the upright walls, starting with the lower upright wall 31 and progressing up to the upper upright wall 21, being of increased slope (relative to the horizontal) as the L-shaped shelves progressively step upwardly. This varying sloped relationship between the different shelves facilitates both visibility and access to the papers stored thereon when the organizer is being used by a worker.

The paper support 13 is, in the illustrated embodiment, also provided with a generally horizontal flange 35 which joins to the front edge of the bottom wall 34 and projects horizontally therefrom through a small extent. This horizontal flange 35 preferably defines therein a groove or channel 36 which extends longitudinally along the flange. This groove 36 functions to retain erasable marking pens and the like. The front edge of horizontal flange 35 in turn is joined to a downward flange 37, the latter functioning to provide additional strength and reinforcement.

The stepped paper support 13 is also provided with a top flange 41 which is joined through a rounded corner 42 to the upper edge of the upright wall 21. This top flange 41 projects generally horizontally rearwardly away from the upright wall 21 through a small extent, and flange 41 at its rear edge terminates in an upwardly projecting flange 43, the latter functioning as a retaining rim and providing additional strength and reinforcement. The top flange 41 preferably slightly downwardly slopes as it projects rearwardly, whereby this flange and its cooperation with the rear flange 43 functions as a storage shelf for marking pens, erasers and the like.

The stepped paper support 13 is preferably formed from a thin material, such as structural plastics or fiberglass, so that the support 13 can be integrally formed in one piece while still possessing the necessary strength and rigidity. This thus results in the stepped support 13 having a thin plate like construction to simplify both the size and weight thereof. Further, the selected material, namely plastics or fiberglass or equivalent, preferably provide the entire support 13 with a front surface 44 which is suitable for use with erasable marking pens so that, in addition to supporting papers, the worker can also utilize the front surface 44 for writing or sketching by use of conventional erasable soft-tipped marking pens, which writing or sketching can be thereafter be easily erased.

The stepped paper support 13 extends between side edges 51 and 52, which side edges are preferably defined by and disposed within vertical planes.

The stepped support 13 is preferably formed so as to have an arcuate configuration generated on a radius about a vertical centerline, such centerline being indicated at 54 in FIG. 3. By generating the stepped support 13 on a radius about a centerline such as indicated at 54, this thus results in each of the upper, intermediate and lower trays or shelves being effectively generated about the same vertical centerline. This results in the stepped shelf 13 having an arcuate configuration when viewed in plan view, and this configuration in conjunction with the stepped and varying sloped relationship of the vertically spaced support shelves facilitates convenient access to the various shelves and various locations along the individual shelves. For example, organizers 10 are disposed in adjacent relationship so as to define an arcuate assembly as illustrated by FIGS. 1 and 3. The worker can stand or sit in the open region 55 defined by the plurality of organizers 10, and due to the fact that these organizers 10 are generated about the vertical centerline 54 as defined within this region 55, and the fact that the shelves are generated on an average radius R, which radius extends to the intermediate shelf section and represents a convenient reaching distance for the worker, this enables the worker to readily access all regions of the upper, intermediate and lower shelves without requiring the worker to undergo significant movement of the entire body.

To enable the plurality of organizers 10 to be positioned edge to edge and define an arcuate arrangement as illustrated by FIGS. 1 and 3, the edges 51 and 52 of each organizer 10 are defined within vertical planes which in effect substantially pass through the vertical centerline 54, and this necessarily results in each organizer 10 at its upper edge having a greater radius and hence a greater circumferential extent than at the lower edge thereof.

Each organizer 10 is preferably provided with a suitable support or leg structure 61 for permitting the organizer to be supported on a floor in a desired upwardly spaced relationship. In the illustrated embodiment, the leg structure 61 includes a plurality of upright legs 62 which engage the floor and, at their upper ends, are joined to a mounting bracket or plate 63. The latter overlaps and is secured to a reinforcing or thickened portion 66 provided on the rear side of the intermediate upright wall 26. Suitable fasteners such as screws or the like can be provided for securing the bracket to the upright support.

It will be appreciated that, if necessary or desired, the support bracket can include upwardly and downwardly projecting legs for engaging and supporting the rear of the upper and lower upright walls 21 and 31 if desired. In addition, it will be appreciated that the leg structure 61 can be attached to the upright support 13 by any type of conventional detachable bracket structure so as to facilitate removal of the leg structure if desired, thereby permitting convenient stacked storage of a plurality of stepped supports 13.

In the paper support assembly 11 illustrated by FIGS. 1 and 3, each support 10 extends through an angle of about 70°, and the three illustrated organizers 10 when assembled in a continuous arcuate relationship hence extend through an angle of about 210°. This represents about the maximum angle which can be continuously defined and utilized without requiring significant turning of the user so as to make effective use of the assembly. It will be appreciated, however, that even a single assembly can be effectively utilized, and that the arcuate extent of the assembly can obviously be varied depending upon the desired working conditions and relationships. Further, a single organizer 10 is believed particularly suitable for use in a corner of an office since such organizer will readily fit within a corner and permit efficient and effective utilization of space which otherwise is often not effectively usable. It will be further recognized that the paper organizer can also be provided with a horizontally straight configuration, rather than an arcuate configuration as illustrated and described above, although the arcuate configuration is highly preferred since such greatly increases the overall flexibility and convenience of use as is believed apparent from the above description.

Figure 4:
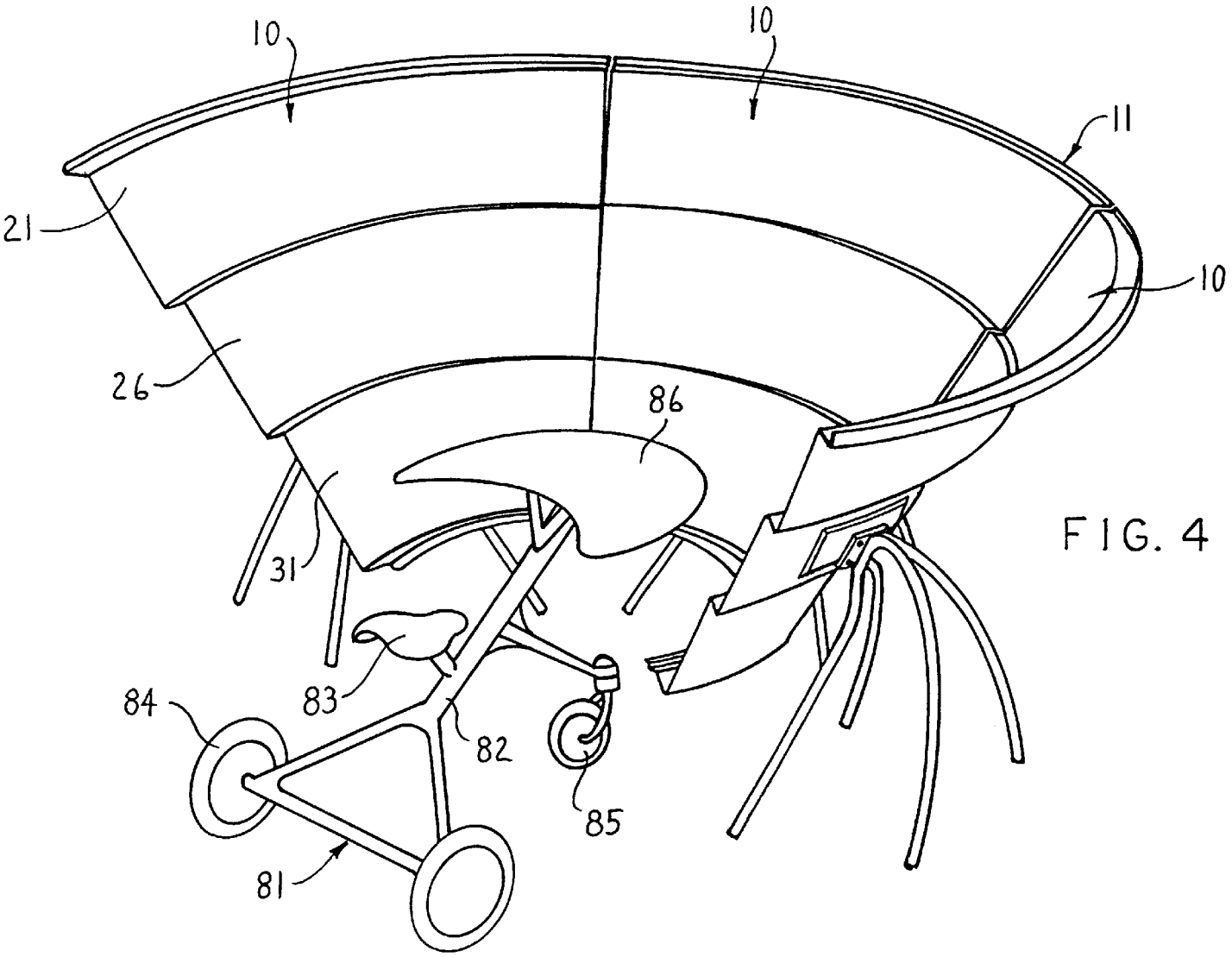
FIG. 4 is a view corresponding to FIG. 1 but illustrating a mobile worker support used in conjunction with the spacial organizer.

Referencing now FIG. 4, there is illustrated an assembly of organizers 10 corresponding to that illustrated in FIG. 1, and thus further description of the assembly 11 will not be presented. In FIG. 4, however, the assembly 11 is being used in conjunction with a mobile worker support 81 which includes a frame 82 provided with a seat 83 for a worker. The frame is of a generally tripod construction in that it provides a three-wheeled support, namely it mounts thereon two coaxially aligned rear wheels 84 and a front wheel or caster 85. The frame at its front is provided with a tray or shelf 86 which is positioned forwardly of the seat so that the worker can sit on the seat 83 and position his arms or other papers on the tray 86. The worker, when seated on the seat 83, will effectively straddle the frame so that both feet engage the floor. The worker then uses his feet to selectively move and position the support 81 due to the provision of the front caster 85, whereby the worker can thus be seated and have mobility while working adjacent or in conjunction with the paper organizer assembly 11. Use of the mobile support 81 is particularly desirable in those situations where the worker has large numbers of papers displayed and organized on the upper, intermediate and lower shelves, and is using the mobile support 81 and its support tray or worksurface 86 to carry out other tasks, while having convenient visual access to the many papers supported on the organizer assembly 11.

The mobile support 81 is illustrated and described in detail in my copending U.S.A. provisional application entitled "Office Scooter With Attached Worksurface" as filed concurrently herewith (attorney reference: Haworth PA-004), and the disclosure of this copending provisional application is incorporated herein by reference.

Although a particular preferred embodiment of the invention has been disclosed in detail for illustrative purposes, it will be recognized that variations or modifications of the disclosed apparatus, including the rearrangement of parts, lie within the scope of the present invention.

I claim:

1. A paper organizer for an office or the like, comprising: a generally enlarged and upright support member of vertically stepped cross-section and including an upper L-shaped support shelf which at its lower edge is rigidly joined to an upper edge of an intermediate L-shaped support shelf, and said intermediate L-shaped support shelf at its lower edge being rigidly joined to an upper edge of a lower generally L-shaped support shelf, each L-shaped support shelf including a generally planar upright wall which at its lower edge is joined to a bottom wall which projects transversely outwardly away from a front surface of the respective upright wall, said bottom wall having a width which is a small fraction of the height of the respective upright wall, each shelf being adapted to support papers thereon in a generally upright position so that the papers rest against the respective upright wall with a lower edge of the paper bearing against the respective bottom wall, said bottom wall of at least one of said shelves and the respective upright wall together define an angle of less than 90°.

2. A paper organizer according to claim 1, including a leg structure affixed to a rear of said upright support member for stably maintaining same in upwardly spaced relation from a floor.

3. A paper organizer according to claim 1, wherein the lower upright wall projects upwardly at a first slope relative to a horizontal, wherein the intermediate upright wall projects upwardly at a second slope relative to the horizontal which is greater than said first slope, and wherein said upper upright wall projects upwardly at a third slope relative to the horizontal which is greater than said second slope.

4. A paper organizer according to claim 3, wherein said organizer is horizontally elongated and has a horizontally arcuate configuration so that front faces of said upright walls have a concave horizontal curvature.

5. An organizer according to claim 4, wherein said horizontally arcuate configuration of said organizer is generated about a vertical axis so that said upper upright wall is generated about a first radius which is greater than a second radius used to generate said intermediate upright wall which in turn is greater than a third radius used to generate the lower upright wall, all of said radii being generated about said vertical axis.

6. An organizer according to claim 1, wherein said upright walls have smooth front surfaces of a material which permits their use with erasable marking pens.

7. A paper organizer for an office or the like, comprising: a generally enlarged and upright support member of vertically stepped cross-section and including an L-shaped support shelf which at its lower edge is fixedly and non-releasably joined to a lower generally L-shaped support shelf, each L-shaped support shelf including a generally planar upright wall which at its lower edge is joined to a bottom wall which projects transversely outwardly away from a front surface of the respective upright wall, said bottom wall having a width which is a small fraction of the height of the respective upright wall, each shelf being adapted to support papers thereon in a generally upright position so that the papers rest against the respective upright wall with a lower edge of the paper bearing against the respective bottom wall, the lower upright wall projecting upwardly at a first slope relative to a horizontal, and said upper upright wall projecting upwardly at a second slope relative to the horizontal which is greater than said first slope.

8. A paper organizer according to claim 7, wherein said organizer is horizontally elongated and has a horizontally arcuate configuration so that front faces of said upright walls have a concave horizontal curvature.

9. An organizer according to claim 7, wherein said upright walls have smooth front surfaces of a material which permits their use with erasable marking pens.

10. A paper organizer according to claim 7, including a plurality of said upright support members each having a horizontally arcuate configuration so that front faces of the respective upright walls have a concave horizontal curvature, said upright support members together defining a generally semi-circular arrangement when disposed in a horizontally adjacent end-to-end manner with one another.

11. A paper organizer according to claim 7, including a leg structure affixed to a rear of said upright support member for stably maintaining same in upwardly spaced relation from a floor.

12. A paper organizer according to claim 7, wherein the upright wall of the lower L-shaped support shelf is directly joined to a front edge of the bottom wall of said lower L-shaped support shelf.

13. A paper organizer according to claim 7, wherein the upright wall of the upper L-shaped support shelf has a storage shelf that is joined to an upper edge of said upright wall and projects outwardly from a back surface of said upright wall, said storage shelf being adapted to support objects thereon.

14. A paper organizer according to claim 7, wherein said lower L-shaped support shelf bottom wall includes a groove disposed therein for storage of marking instruments.

15. A paper organizer according to claim 1, including a plurality of said upright support members each having a horizontally arcuate configuration so that front faces of the respective upright walls have a concave horizontal curvature, said upright support members together defining a generally semi-circular arrangement when disposed in a horizontally adjacent end-to-end manner with one another.

16. A paper organizer according to claim 1, wherein said lower L-shaped support shelf bottom wall includes a groove disposed therein for storage of marking instruments.

17. A multi-level paper organizer for an office or the like, comprising:

a generally enlarged and upright support member of vertically stepped cross-section having an upper L-shaped support shelf which at its lower edge is joined to a lower L-shaped support shelf, each L-shaped support shelf including a generally enlarged planar upright wall and a bottom wall which projects outwardly from a lower edge of said respective upright wall, said bottom wall having a front edge, said upper L-shaped support shelf bottom wall front edge being directly and fixedly joined to said lower L-shaped support shelf upright wall, said bottom wall having a width that is a small fraction of the height of the respective upright wall, said lower upright wall projecting upwardly at a first slope relative to a horizontal and said upper upright wall projecting upwardly at a second slope relative to the horizontal which is greater than said first slope, each shelf being adapted to support papers thereon in a generally upright position so that the papers rest against the respective upright wall with a lower edge of the paper bearing against the respective bottom wall.

* * * * *